United States Patent [19]

Mydill

[11] Patent Number: 4,855,969

[45] Date of Patent: Aug. 8, 1989

[54] DYNAMIC TIMING REFERENCE ALIGNMENT SYSTEM

[75] Inventor: Marc R. Mydill, Garland, Tex.

[73] Assignee: Texas Instruments Incorporated, Dallas, Tex.

[21] Appl. No.: 96,871

[22] Filed: Sep. 14, 1987

[51] Int. Cl.[4] ..... G04F 10/00

[52] U.S. Cl. ..... 368/120; 324/77 R

[58] Field of Search ..... 368/118–120, 368/113–117; 324/73 R, 73 AT, 73 PC

[56] References Cited

U.S. PATENT DOCUMENTS

| | | | |
|---|---|---|---|
| 4,161,691 | 7/1979 | Vemeers | 368/118 |
| 4,164,648 | 8/1979 | Chu | 368/118 |
| 4,736,351 | 4/1988 | Oliver | 368/118 |

*Primary Examiner*—Bernard Roskoski

*Attorney, Agent, or Firm*—Joseph E. Rogers; James T. Comfort; Melvin Sharp

[57] ABSTRACT

Disclosed is a test system and a method for providing a timing function that dynamically calculates and adjusts the phase delay between an internal timing reference and an externally derived signal. This is accomplished by providing a timing generator for providing a master timing reference signal, first, second and third counters preset at the beginning of each test cycle to each provide a count responsive to the timing reference signal, first and second multiplexers, each associated with one of the first and second counters, and first and second comparators for comparing the contents of each of the first and second multiplexers with the count of an associated counter and producing a timing edge when a count match occurs.

17 Claims, 2 Drawing Sheets

DYNAMIC TIMING REFERENCE ALIGNMENT SYSTEM

FIELD OF THE INVENTION

This invention relates to test systems and more particularly to a method of adjusting the phase delay between an internal timing reference and an externally derived signal.

PRIOR ART

Logical test systems stimulate devices under test (DUT) with predefined, formatted wave forms. The test system provides the timing reference for the formatted wave forms. During functional testing, the test system must monitor the response of the DUT by comparing the captured DUT response with expected data. Since the timing characteristic of the DUT response is generally known, the timing of the expected data can be predefined to occur synchronously with the DUT response.

Some devices require all external events to be synchronized with a timing reference supplied by the DUT. During the testing, this timing reference may be derived from an internal DUT timing circuit or from a tester timing signal. If the reference is derived from a tester timing signal, the phase delay of the resulting DUT timing reference may vary unpredictably and may also be temperature dependent. Functional testing of the DUT, therefore, must be interrupted or disturbed in order to determine the phase delay between the tester timing signal and the DUT timing reference so that the stimulus and expected response timing provided by the tester can be properly aligned with the DUT.

While there are no known systems or methods utilizing the present invention, the problem is recognized in a paper OPTIMIZING THE TIMING ARCHITECTURE OF A DIGITAL LSI TEST SYSTEM, IEEE catalog No. 83CH1933-1, Computer order No. 502, Library of Congress No. 83-8105, Paper 8.5. A start-stop oscillator is described. The test system uses a continuously adjusted, retriggerable start-stop oscillator to maintain phase lock between the DUT and tester timing reference.

In the described system, the test system is phase locked to the DUT, which prescribes the DUT to be the master reference, and the external sync mode of the tester not be capable of being enabled or disabled "on the fly".

BRIEF DESCRIPTION OF THE INVENTION

The present invention provides a timing function to a test system that dynamically calculates and adjusts the phase delay between an internal timing reference and an externally derived signal. This provides a means for quickly synchronizing the test system timing to a reference DUT output. The invention may be used in conjunction with the test system described and claimed in copending patent application Ser. No. 697,231 filed Sept. 14, 1987, and entitled FUNCTION ARRAY SEQUENCING SYSTEM FOR VLSI TEST SYSTEM. Because the invention uses a digital synchronization loop, as opposed to analog phase lock loop, the synchronization may be accomplished quickly, thereby giving a significantly reduced test time.

The invention is implemented in a multi-edge, tracking delay generator system (MTDG). A master timing reference signal is used as a time base in the system. The master timing reference signal is applied to a counter, the counter being preset to zero at the beginning of each test cycle and counting the cycle.

The contents of the counter are continuously compared with values provided to an edge comparator. Whenever a match occurs, a timing edge (start or stop) is produced and may be delayed further for finer resolution.

A four input multiplexer switches values each time an edge is produced, therefore multiple edges (up to four) may be generated during each test cycle. The multiplexed values are added to the contents of the edge comparator. The edge comparator is initially loaded with zero and the initial content of the edge counter defines the width of each start-stop edge pair. The edge counter may be incremented or decremented, to change the values presented to a comparator. This in effect advances or delays the start-stop edge pair.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT OF THE INVENTION

Figure 1:
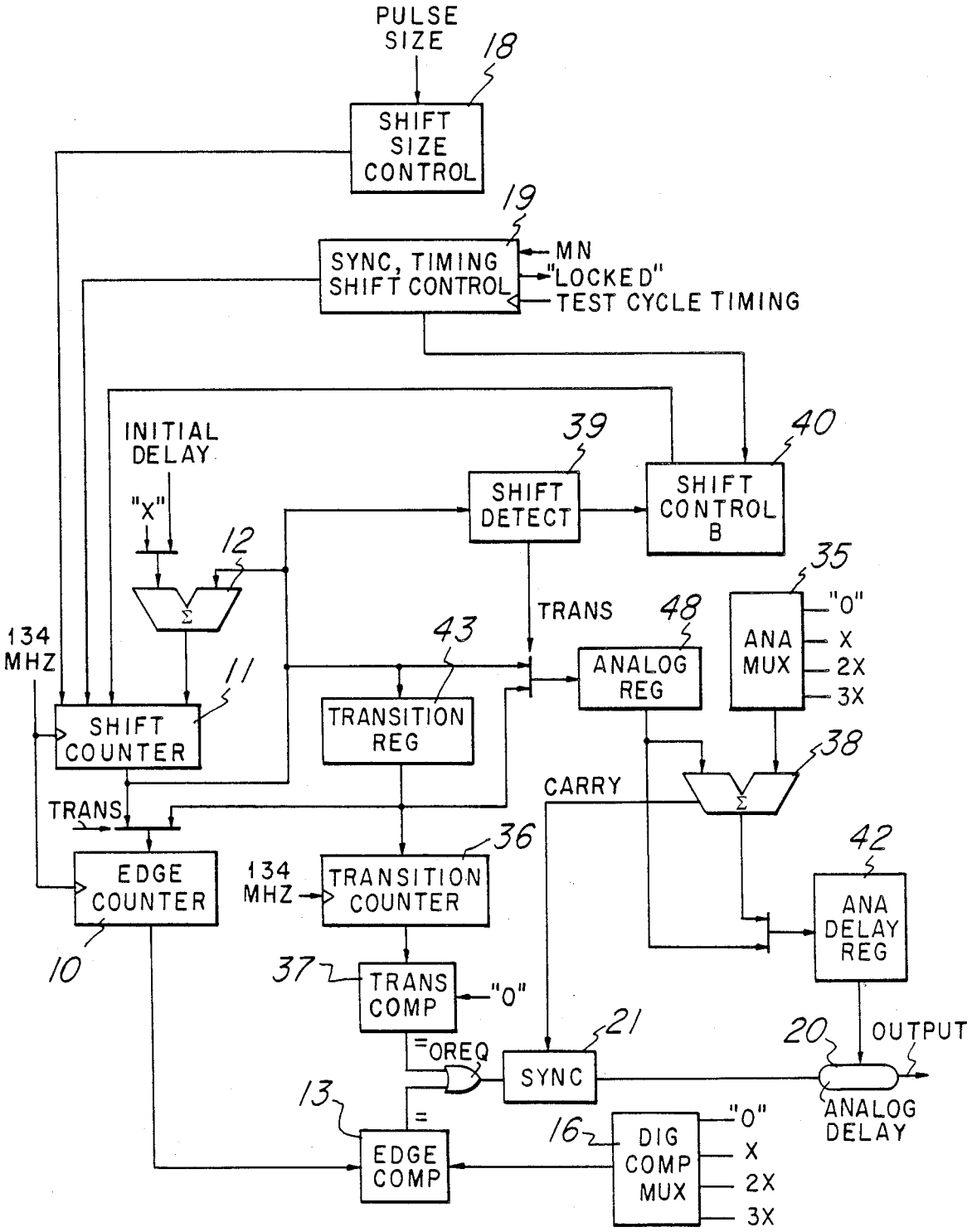
FIG. 1 is a block diagram of a multi-edge tracking delay generator system.

A MTDG system is illustrated in FIG. 1. The time base of the MTDG is a 134 Mhz master reference signal. A 134 Mhz edge counter 10 is preset to zero at the beginning of each test cycle and counts during the cycle. The contents of the 134 Mhz counter 10 are continuously compared with the values provided to an edge comparator 13 by a four input digital comparator multiplexer 16. Whenever a match occurs, a timing edge, either start or stop, from comparator 13 is produced and delayed further for a finer resolution.

The four input multiplexer 16 switches values each time an edge is produced, therefore, multiple edges, up to four, may be generated during each test cycle. The multiplexed values are added to the contents of the shift counter 11. The contents of shift counter 11 are added to the sub period X in summing units 12 and 38.

Shift counter 11 is initially loaded with zero. The initial contents of a stop shift counter (not illustrated) define the width of each start-stop edge pair. The shift counter may be incremented or decremented to change the values presented to the edge comparators and analog delays. This in effect advances or delays the start-stop edge pair.

The primary functions performed by the MTDG are to provide multiple clock edge pairs (pulses) within a period defined as a TZ period, to dynamically adjust the phase of the edges based on feed back from a device under test (DUT), and to monitor selected DUT feedback to determine the amount and direction of dynamic MTDG phase adjustment required.

The above functions are directly applicable when synchronizing a test system to a DUT that requires a tester generated timing input, yet produces a phase shifted timing reference output derived from the tester supplied input. In such a case, the MTDG system can be used to provide the DUT timing input and dynamically shift the input in order to maintain a fixed timing relationship between the tester and the DUT timing reference output.

THEORY OF OPERATION

Edge Generation

The MTDG system produces a selected number of edge pairs (or pulses) within a TZ period. The following description is directed to the generation and control of one of the edges of each edge pair. The generation and control of the other edge is essentially identical.

The origin of every MTGD edge can be described through the operation of the edge counter 10, edge comparator 13 and digital comparator multiplexer 16. At the beginning of every TZ cycle, the edge counter 10 is reloaded with zero. The counter 10 counts at 134 Mhz through the TZ period, until it is reloaded at the beginning of the next period. Therefore the edge counter 10 counts from 0 to n during every TZ period, where n equals the number of 134 Mhz cycles within a TZ period.

The output of the edge counter 10 is continuously compared, via the edge comparator 13, to values provided by the comparator mux 16. Whenever the edge counter's output matches the value provided by the mux, an edge is generated. This edge is sent through sync circuit 21 to an analog delay 20 for finer delay resolution. The analog delay is programmed with data provided by an analog delay mux 35 which data is summed with analog data from register 41. The digital comparator mux 16 and the analog delay mux 35 select one of a set of values as inputs to the edge comparator and the analog delay. The data that the multiplexers select are preprogrammed values representing equally spaced divisions in the TZ period. These divisions are defined by a 12 bit edge count and an associated 6 bit analog delay value. One to four such divisions may be specified within each TZ period. Both multiplexers are initialized at the beginning of each TZ period. Each time an edge is generated, the select inputs to both multiplexers are incremented, which sets up the values for the next edge.

Dynamic Edge Shift

In order to dynamically shift the MTDG edges, an up/down shift counter 11 is used. This counter is incremented or decremented whenever an MTDG edge shift is to be performed.

The 12 MSBs of the shift counter 11 provide a value to be loaded into the edge counter 10 at the beginning of every TZ period. This value represents an initial bias with respect to the comparator data provided by the digital comparator mux. For example, if the digital comparator mux 16 value given to the edge comparator is X, then the edge counter must count to X before an edge is produced. If the edge counter is initially loaded with zero, exactly X counts will occur before an edge is generated. One count equals 7.45 ns. If the edge counter had been loaded with a 1, then one less count would be required for the edge counter to reach X, (X−1 counts). If the edge counter had been loaded with a −1, the X+1 counts would be required before and edge is generated.

The operation of the 12 MSBs of the shift counter may be summarized as follows: (a) if the shift counter 11 is incremented, the MTDG edge will be digitally advanced, and (b) if the shift counter 11 is decremented, the MTDG edges will be digitally delayed in time. The initial edge counter bias will also advance or delay any subsequent sub-TZ period divisions (MTDG edges) set up by the digital comparator mux values.

For smaller shift increments, the six LSBs of the shift counter are added to the analog mux output. If the analog shift plus analog mux value>7.45 ns, then an extra digital count is created for that edge with sync circuit 21. This stage of the shift counter (lower 6 bits) must operate backwards from the upper 12 bits of the counter. In order to delay MTDG edges, the analog stage is incremented, whereas the digital state (upper 12 bits) is decremented. This is done by reversing the control inputs and carry in/out signals between the two stages.

Due to synchronization requirements of the period generator, and in order to achieve unlimited shifting range, the shift count must be recalculated and the shift counter reloaded whenever an MTDG edge is shifted across a TZ boundary in either direction.

Figure 2:
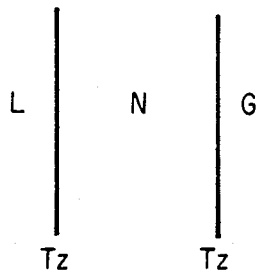
FIG. 2 defines three relative shift regions for an MTDG edge with respect to a time reference.

FIG. 2 defines three relative shift regions for an MTDG edge with respect to TZ. The center region N is defined as a datum region. All shifts within this region are accomplished normally, i.e. incrementing or decrementing the shift counter. If the edge is shifted from the N region across the TZ boundary to the right and into the G region, a special shift occurs, NG shift.

Shifting over a TZ boundary requires that the shift count be recalculated and the shift counter be reloaded with the calculated value. This value for an NG shift is:

New Shift Value (NSV)=Cumulative Shift Value (CSV+P where

NSV,CSV=value loaded into the shift counter

P=period of the MTDG wave form

In this case, CSV<−(P). If the MTDG edge is shifted to the left so that it crosses the TZ boundary into the L region, NL shift, the shift count must be recalculated as follows:

$$NSV=CSV-P$$

In this case CSV<P. The shift count detect circuitry (39,40) continuously monitors for the CSV in order to detect an NL or NG boundary crossing.

Edge Compression

Figure 3:
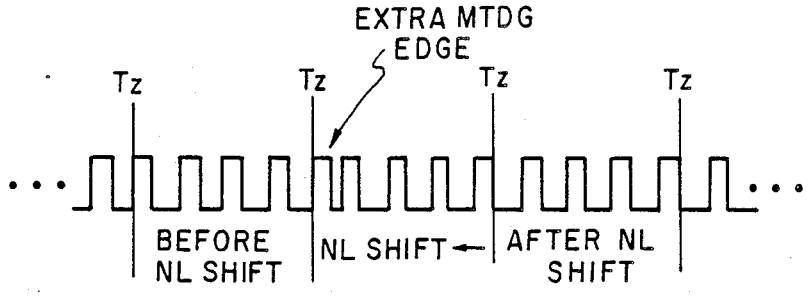
FIG. 3 illustrates the shifting of an MTDG edge across the time reference boundary.

During an NL shift, an extra MTDG edge is required within the TZ period that the shift occurs. This is illustrated in FIG. 3. In order to accomplish this wave form compression, the MTDG must switch from the previous shifted value to the new shift value during one TZ period. This is done by enabling a second digital edge comparison to be made with the outputs of the transition counter 36. This counter is always loaded with the previous shift count, however, the transition comparator 37 is only enabled during an NL shift cycle, and then disabled such that only one extra MTDG edge is generated. Therefore, during an NL shift cycle, the digital edge comparator generates the newly shifted edges, while the transition comparator generates one edge from the previous shift value. NL and NG shift control is provided by the shift detect circuitry 39, and shift control B 40.

MTDG Shift Control

Figure 4:
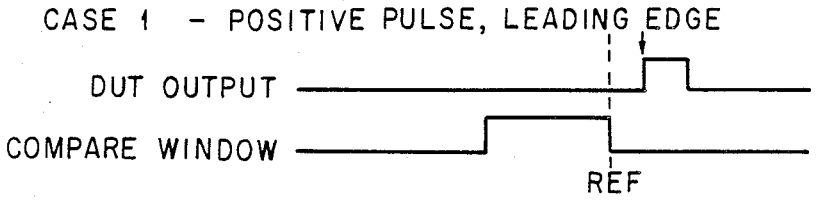
FIGS. 4, 5, 6 and 7 illustrate four possible DUT output signal reference points that are derived from timing provided by the MTDG system.
Figure 5:
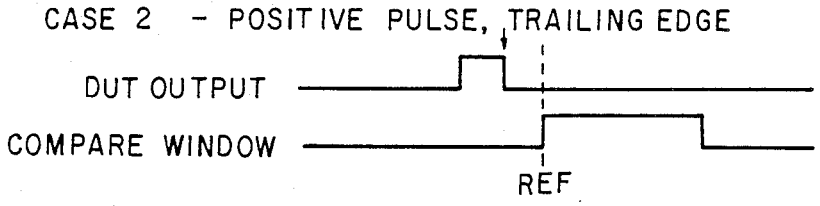
Figure 6:
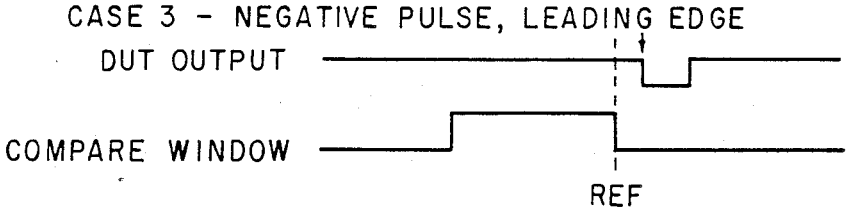
Figure 7:
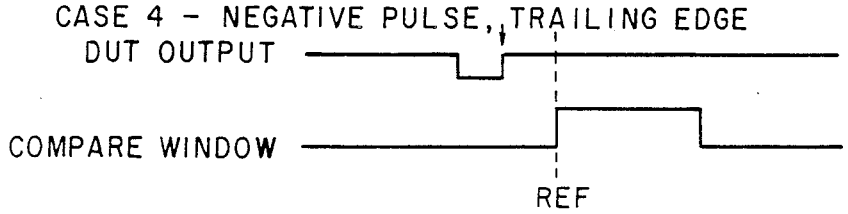

The shift control for the MTDG output is provided by the sync, timing, shift control circuit 19 and shift size control circuit 18. The operation of the shift control required for the MTDG to acquire and maintain synchronization can be shown through the examples illustrated in FIGS. 4, 5, 6, and 7. These figures represent four possible DUT output signal reference points that are derived from the timing provided by the MTDG system. The four possible DUT output signal reference points are: Positive pulse, leading edge (FIG. 4), positive pulse, trailing edge (FIG. 5), negative pulse leading edge (FIG. 6), and negative pulse trailing edge (FIG. 7).

The objective is to shift the MTDG input to the device, thus shifting the DUT output derived from the MTDG signal so as to position the DUT output signal references, indicated by arrows on the wave forms, at a predetermined tester timing reference, indicated by REF.

The REF point is an edge of a tester compare window. The DUT output signal is monitored during the duration of this window. The tester will expect a value during this window (1 or 0). If a match occurs (MM=0) at any time during the window, the control will instruct the MTDG to shift in one direction. If no match occurs during the window (MM=1) the MTDG will be instructed to shift in the opposite direction.

The shift rule will depend on the type of DUT signal (positive or negative) and edge, leading or trailing, that is to be aligned. This will also determine if the leading or trailing edge of the window is positioned at the tester reference point as well as what the expected value is.

The shift control information (shift right, shift left, hold, and increment size) is obtained by monitoring and tracking an External Timing Input signal (ETI). The MTDG control system operates in three modes, locking mode, tracking mode and fixed mode.

In the locking mode, the MTDG will be initially shifted in order to position the ETI at a predefined tester timing reference point. It is assumed that the ETI is derived from the MTDG signal so that there will be nearly constant phase relationship between the two.

The initial MTDG shifts are made as large as possible in order to reduce the number of test cycles required to achieve initial synchronization. Once initial sync is acquired, the MTDG will continue to monitor the ETI. The MTDG system will then dynamically track the ETI (tracking mode), or inhibit MTDG shifting (fixed mode) as instructed by each pattern being executed. Both initial shifts and tracking adjustments are made once every nine cycles in order to filter out the ETI jitter.

The ETI is synchronized to the tester by first specifying a Tester Timing Reference point (TTR) with respect to TZ. This is the point to which the ETI will be aligned. The TTR is programmed as a selected edge of a receive clock compare window, the edge depending on the nature of the ETI. During synchronization and tracking, the ETI is monitored with the reference window. If the ETI occurs outside the window, an MTDG shift in a predetermined direction will be made. If the ETI occurs within the reference window, the MTDG signal will be shifted in the opposite direction.

The shift direction convention depends on the characteristics of the ETI. The window comparisons for every TZ cycle are monitored, however, no shift will be made until the ETI occurs within the reference window or outside the reference for eight consecutive TZ cycles.

After initial synchronization, the ETI jitter will be centered at the TTR and no adjustments will be made until the net ETI jitter drifts to either side of the TTR.

Each time the shift direction is reversed, the shift increment size is reduced. When the smallest shift increment is reached, the ETI is synchronized and the MTDG control will continue to track or remained fixed as instructed by each functional pattern.

What is claimed:

1. In a tester for testing very large scale integrated circuits wherein a device under test requires a tester generated timing input that has to be dynamically shifted to maintain a fixed timing relationship between the tester and the timing reference output of the device under test, a multi-edge delay generator comprising:

(a) a timing generator for providing a master timing reference signal, (b) first, second and third counters preset at the beginning of each test cycle to each provide a count responsive to said timing reference signal, (c) first and second multiplexers, each associated with one of said first and second counters, and (d) first and second comparators for comparing the contents of each of said first and second multiplexers with the count of an associated said counter and producing a timing edge when a count match occurs.

2. The delay generator according to claim 1, where in the first counter is an edge counter, the second counter is a shift counter and the third counter is a transition counter.

3. The delay generator according to claim 1 where in the timing edge produced is a start edge.

4. The delay generator according to claim 1 where in the timing edge produced is a stop edge.

5. The delay generator according to claim 1 further including a multiplexer switch for switching edge values each time an edge is produced.

6. The delay generator according to claim 5 wherein the multiplexer switch provides up to four values.

7. The delay generator according to claim 5 including an edge comparator wherein the contents of the edge comparator is compared with the edge values from the multiplexer.

8. In a tester for testing very large scale integrated circuits wherein a device under test requires a tester generated timing input that has to be dynamically shifted to maintain a fixed timing relationship between the tester and the timing reference output of the device under test, a multi-edge delay generator comprising timing reference signal generator for producing a reference signal, a counter for counting the reference signal for a defined period, a comparator, and a multiplex switch associated with a plurality of input values, a selected one said input values of which is supplied to said comparator, said comparator comparing the counter output with one of the plurality of input values from said multiplexer until the counter output matches the value provided by the multiplexer, the comparator then producing a timing edge signal that may be shifted.

9. The delay generator according to claim 8 where in the counter is an edge counter and the comparator is an edge comparator, the edge comparator continuously comparing the output of the edge counter with the value provided by the multiplexer, and when a match occurs, and edge is generated.

10. The delay generator according to claim 8 further including an analog delay multiplexer and an analog delay circuit for providing finer resolution of the edge.

11. The delay generator according to claim 8 including an up/down shift counter to incremented or decremented when an edge shift is to be performed.

12. The delay generator according to claim 11 wherein and edge is digitally advanced when the shift counter is incremented.

13. The delay generator according to claim 11 wherein and edge is digitally delayed when the shift counter is decremented.

14. In a tester for testing vary large scale integrated circuits wherein a device under test requires a tester generated timing input that has to be dynamically shifted to maintain a fixed timing relationship between the tester and the timing reference output of the device under test, a multi-edge delay generator comprising:

(a) means for providing multiple clock edge pulses within a defined period, (b) means for dynamically adjusting the phase of the edge pulses responsive to feedback signals from the device under test, and (c) means responsive to the feedback signals from the device under test to determine the amount and direction of dynamic multi-edge generator phase adjustment.

15. Multi-edge delay generator according to claim 14, wherein the means for providing multiple clock edge pulses with in a defined period includes a timing generator and an edge counter.

16. The multi-edge delay generator according to claim 14, wherein the means for dynamically adjusting the phase of the edges based upon feed back from the device under test includes an edge comparator and a multiplexer for supplying selected values for comparing with the multiple clock edge pulses.

17. The multi-edge delay generator according to claim 14, wherein the means for selecting the feedback from the device under test to determine the amount and direction of dynamic multi-edge delay generator phase adjustment includes a shift counter.

* * * * *